US010753570B2

(12) United States Patent
Herbin et al.

(10) Patent No.: US 10,753,570 B2
(45) Date of Patent: Aug. 25, 2020

(54) MOTOR VEHICLE LIGHT DEVICE CASING

(71) Applicant: VALEO VISION BELGIQUE, Meslin-l'evenque (BE)

(72) Inventors: Cyril Herbin, Bobigny (FR); Guillaume Larche, Bobigny (FR); David Boudikian, Bobigny (FR)

(73) Assignee: VALEO VISION BELGIQUE, Meslin-l'evenque (BE)

( * ) Notice: Subject to any disclaimer, the term of this patent is extended or adjusted under 35 U.S.C. 154(b) by 28 days.

(21) Appl. No.: 15/427,153

(22) Filed: Feb. 8, 2017

(65) Prior Publication Data

US 2017/0234502 A1 Aug. 17, 2017

(30) Foreign Application Priority Data

Feb. 15, 2016 (FR) ..... 16 51210

(51) Int. Cl.

| | |
|---|---|
| ***F21V 9/00*** | (2018.01) |
| ***F21S 45/10*** | (2018.01) |
| ***F21S 45/47*** | (2018.01) |
| ***F21S 43/19*** | (2018.01) |
| ***F21S 43/237*** | (2018.01) |
| ***F21S 41/19*** | (2018.01) |

(Continued)

(52) U.S. Cl.

CPC ..... *F21S 45/10* (2018.01); *F21S 41/143* (2018.01); *F21S 41/19* (2018.01); *F21S 41/24* (2018.01); *F21S 43/19* (2018.01); *F21S 43/237* (2018.01); *F21S 43/245* (2018.01); *F21S 43/26* (2018.01); *F21S 43/31* (2018.01); *F21S 43/33* (2018.01); *F21S 43/40* (2018.01); *F21S 45/00* (2018.01); *F21S 45/47* (2018.01); *F21S 45/50* (2018.01)

(58) Field of Classification Search

CPC ..... B60Q 3/60; B60Q 3/82; H03K 17/962

USPC ..... 362/509, 23.03, 23.04, 85, 88, 94, 95, 362/111, 114, 204, 205, 212, 249.05, 362/249.12, 394, 395, 265; 313/113, 116, 313/110, 236; 433/29; 439/226, 611; 307/70.8

See application file for complete search history.

(56) References Cited

U.S. PATENT DOCUMENTS 4,084,215 A * 4/1978 Willenbrock ..... B64F 1/20 313/111

5,258,686 A * 11/1993 Segoshi ..... F21V 25/00 313/313

(Continued)

FOREIGN PATENT DOCUMENTS

DE 102014217200 A1 * 3/2016 ..... B60Q 3/82

*Primary Examiner* — William J Carter
*Assistant Examiner* — Omar Rojas Cadima
(74) *Attorney, Agent, or Firm* — Oblon, McClelland, Maier & Neustadt, L.L.P.

(57) ABSTRACT

The invention proposes a light device casing formed by a wall made of an electrically insulating material, such as a polymer. The casing includes an inner surface forming a housing receiving a light module with a light-emitting diode and a light guide. The inner surface includes a zone reflecting light from the light module out of the casing, and a fixing zone for a control module of the light module. The light device includes a reflecting and electrically conductive coating, which covers both the reflecting zone and the fixing zone. The aluminum coating is cost-effective since it is applied in one step, and it ensures two functions, namely a reflection and a protection against the electromagnetic field.

15 Claims, 3 Drawing Sheets

(51) Int. Cl.

| | |
|---|---|
| ***F21S 43/20*** | (2018.01) |
| ***F21S 43/33*** | (2018.01) |
| ***F21S 43/31*** | (2018.01) |
| ***F21S 43/40*** | (2018.01) |
| ***F21S 41/24*** | (2018.01) |
| ***F21S 41/143*** | (2018.01) |
| ***F21S 43/245*** | (2018.01) |
| ***F21S 45/00*** | (2018.01) |
| *F21S 45/50* | (2018.01) |

(56) References Cited

U.S. PATENT DOCUMENTS 5,882,108 A * 3/1999 Fraizer ..... F21S 48/1186
362/265
2011/0038172 A1* 2/2011 Vollmer ..... F21V 3/04
362/543

* cited by examiner

MOTOR VEHICLE LIGHT DEVICE CASING

TECHNICAL FIELD

The invention relates to a light device for a vehicle, of the type comprising a casing closed by a transparent outer lens. More specifically, the invention relates to a light device with a source of electromagnetic field, and possibly a light guide in the casing.

PRIOR ART

A vehicle light device generally combines one or more light sources. These can be of the diode type and be associated with as many light guides having an elongate form which sweeps the length of the light device. The electrical power is supplied via a control board which adapts, or converts, the energy available on the vehicle to drive the diodes.

The document FR 3 002 794 B1 discloses a lighting device comprising a casing closed by an outer lens. The casing encloses a printed circuit board which supports a light source cooperating with a light guide. A control module for the light source links the latter to an external power supply.

For efficiency reasons, the control module comprises a switching system involving chopping the signal received. Now, this mode of operation generates a parasitic electromagnetic field which can interfere with various equipment items of the vehicle. For example, this field can disturb the computer of the vehicle; or even the audio device of the vehicle interior. The acoustic quality decreases, which affects the perceived quality of the vehicle.

In order to curb this phenomenon, it is known practice to provide the control board with a shielding of electromagnetic cage type linked to the ground of the electrical circuit of the vehicle. This cage makes it possible to intercept the electromagnetic field and cancel out its pollution. However, the presence of this cage affects the compactness of the assembly in addition to adding weight. This cage incurs expenditure because of the purchase, fitting and possibly control thereof.

SUMMARY OF THE INVENTION

Technical Problem

The aim of the invention is to solve at least one of the problems posed by the prior art. More specifically, the aim of the invention is to reduce the cost of a light device. Another aim of the invention is to improve the electromagnetic protection of a light device. Another aim of the invention is to propose a reliable, simple and lightweight solution.

Technical Solution

One subject of the invention is a light device produced in an electrically insulating material and comprising an inner surface forming a housing, the housing being intended to be closed by an outer lens and to receive a light module; the inner surface comprising: a reflecting zone configured to reflect light emitted by the light module out of the casing, and a fixing zone for a control module of the light module; noteworthy in that the inner surface comprises a reflecting and electrically conductive coating covering both the reflecting zone and the fixing zone of the control module in order to block the electromagnetic field produced by the control module.

According to an advantageous embodiment of the invention, the coating is metallic and extends over most, preferentially over substantially all, of the inner surface of the casing.

According to an advantageous embodiment of the invention, the coating comprises aluminum and the electrically insulating material of the casing is a polymer.

According to an advantageous embodiment of the invention, the fixing zone for the control module is bordered by at least two fixing bosses facing one another, the bosses being covered by the coating.

According to an advantageous embodiment of the invention, at least one or each boss comprises a shoulder forming a bearing surface for the control module, and a fixing axis protruding from the associated shoulder, each shoulder and each fixing axis being covered by the coating.

According to an advantageous embodiment of the invention, the casing comprises an opening, notably a central opening, which is bordered, preferentially surrounded, by the coating.

According to an advantageous embodiment of the invention, the reflecting zone forms a longitudinal groove suitable for reflecting light from a longitudinal light guide in a main direction, the coating covering the longitudinal groove.

According to an advantageous embodiment of the invention, in the normal mounting direction, the coating is more backward in the fixing zone than in the reflecting zone.

According to an advantageous embodiment of the invention, the coating has a constant thickness, possibly less than or equal to 100 μm thick.

According to an advantageous embodiment of the invention, the coating extends from the center of the inner surface to an edge of the casing, preferentially the coating runs along and/or forms the perimeter of the inner surface.

According to an advantageous embodiment of the invention, the coating has a roughness Ra less than or equal to 1μ, preferentially less than or equal to 0.20 μm. It can be polished by a polishing step after the step of application thereof on the inner surface.

According to an advantageous embodiment of the invention, in the normal mounting direction, the coating is more forward in the reflecting zone than in the fixing zone.

According to an advantageous embodiment of the invention, the coating is capable of reflecting half the incident light, preferentially at least 90%, more preferentially at least 95%, possibly substantially all the visible light that it receives.

According to an advantageous embodiment of the invention, the inner surface is produced using the polymer material of the casing, notably on the outer wall thereof.

According to an advantageous embodiment of the invention, in the fixing zone, the inner surface is essentially a free surface.

According to an advantageous embodiment of the invention, the housing comprises a double bottom, the fixing zone of the control module forming the deepest bottom, and the reflecting zone forming the least deep bottom, for example to receive an elongate light guide.

According to an advantageous embodiment of the invention, the coating exhibits a continuity of material over the inner surface.

Another subject of the invention is a light device for a vehicle, notably a motor vehicle, the device comprising a casing and an outer lens which delimit a housing, a light module which is arranged in the housing and which comprises a light source and possibly a light guide associated with the light source, noteworthy in that the casing is in accordance with the invention.

According to an advantageous embodiment of the invention, the control module comprises a heat sink in contact with the coating.

According to an advantageous embodiment of the invention, the light device comprises an electrically conductive washer at the interface between the coating and the heat sink in order to ensure an electrical connection.

According to an advantageous embodiment of the invention, the light device comprises an occulting screen between the fixing zone and the light module which intercepts the radiation from the light module, the field occulted by the screen being also covered by the coating.

According to an advantageous embodiment of the invention, the control module comprises a printed circuit board connected to the light module and to the coating.

According to an advantageous embodiment of the invention, the control module comprises two thickness-wise opposing main faces, the coating closely following substantially all of a main face of the control module.

According to an advantageous embodiment of the invention, the light guide extends over most of the length of the light device or substantially all of its length, the coating running along the light guide over substantially all of its length.

According to an advantageous embodiment of the invention, the light guide forms a bar, possibly of generally constant section.

According to an advantageous embodiment of the invention, the device comprises at least one seal between the housing and the environment of the device, said seal being in contact with the coating.

According to an advantageous embodiment of the invention, the heat sink and the coating are produced in one and the same material, possibly in aluminum.

According to an advantageous embodiment of the invention, the reflecting zone is configured to reflect, and/or project, the light from the light module out of the casing in the main direction of emission of the device, possibly in combination with the outer lens.

According to an advantageous embodiment of the invention, the reflecting zone is facing the outer lens.

According to an advantageous embodiment of the invention, the control module comprises a heat sink and a printed circuit board pressed against the heat sink so as to allow a heat exchange.

According to an advantageous embodiment of the invention, the printed circuit board is in electrical contact with the coating via the heat sink.

According to an advantageous embodiment of the invention, the control module, notably the printed circuit board, is capable of transforming a voltage, and/or is a strobing system capable of chopping a signal.

According to an advantageous embodiment of the invention, the fixing zone of the inner surface closely follows the form of the control module, notably the printed circuit board.

According to an advantageous embodiment of the invention, the casing comprises cable guides covered by the coating.

According to an advantageous embodiment of the invention, the light guide and the control module exhibit main elongations which are generally parallel, and possibly generally parallel to the main elongation of the casing.

According to an advantageous embodiment of the invention, the heat sink is crimped to the printed circuit board and/or snap-riveted to the casing, notably at the bosses.

According to an advantageous embodiment of the invention, the control module, notably the printed circuit board, comprises at least one or more components producing an electromagnetic field in the housing, for example of more than 500 V/m for the electrical field and/or 10 micro teslas for the magnetic field, possibly at 50 Hz.

According to an advantageous embodiment of the invention, the control module and the light guide are generally parallel.

The presence of the reflecting zone is not essential to the invention. Another subject of the invention is a light device with a light source control module, and a casing made of electrically insulating material which has an inner surface which forms a housing receiving the control module, noteworthy in that, at the control module, the inner surface comprises an electrically conductive coating so as to form a screen to the electromagnetic waves emitted by the control module, the coating being optionally reflecting.

Generally, the advantageous embodiments of each subject of the invention are also applicable to the other subjects of the invention. Insofar as possible, each subject of the invention can be combined with the other subjects.

Advantages

The invention makes it possible to reduce the costs of protection against an electromagnetic field, while making it possible to extend the zone where this protection is effective. In effect, since the coating can line all of the casing, it provides effectiveness against other electromagnetic sources.

The coating common to the two zones ensures a dual function. It is a mirror which returns the useful light for lighting, and a trap to electromagnetic waves. It is noteworthy that these two functions are produced by a coating applied in a single operation. The general assembly is simpler since the number of operations is reduced. A risk of detachment of an element in the casing is eliminated.

The extent of the coating makes it possible to electrically link several components to the ground of the corresponding vehicle; also when these components are at opposite ends of the casing. The electrical connections from the control printed circuit board, and/or from the light module are simplified. Cables can be eliminated, the invention once again offers a saving and a lightening.

DESCRIPTION OF THE EMBODIMENTS

In the following description, the terms front and back are considered in the main direction of emission of the light from the light device, and/or in the main direction of displacement of the associated vehicle.

Figure 1:
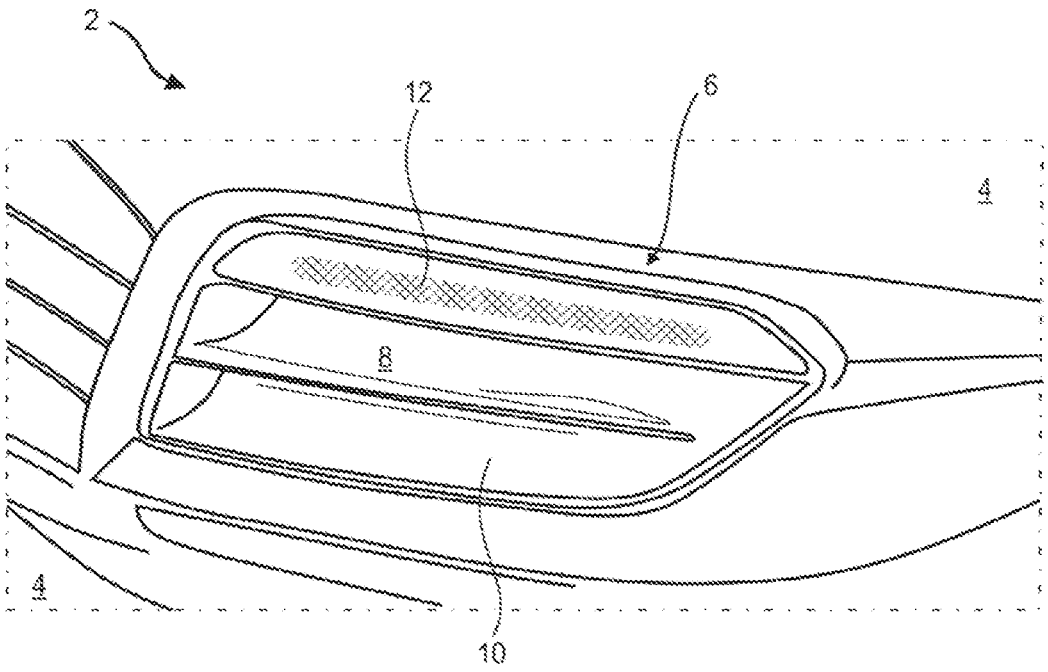
FIG. 1 represents a motor vehicle part with a light device according to the invention.

FIG. 1 shows a simplified representation of a light device 2 of a motor vehicle. The device 2 can correspond to a front right fog light which is incorporated in the bodywork 4 of a vehicle. It can also be a lighting or signaling device, at the front or equally at the rear of the vehicle. It can be a headlight.

The light device 2 comprises a casing 6 defining a housing 8, or a free clearance in the manner of a hollow receptacle. This housing 8 can be a main housing 8. It is delimited by the inner surface of the casing by its walls forming a shell. The housing can be closed by an outer lens 10, notably a projection outer lens which offers two diopters. The thicknesses and the curvatures of the outer lens 10 can participate in directing the light emitted by the light device 2 in a main direction. A seal (not represented) can ensure a seal-tightness between the outer lens 10 and the casing 6, possibly by being placed in a perimeter channel of the latter.

The light device 2 comprises at least one light module, possibly several light modules. Each of them comprises a light source, and possibly a light guide 12 also called waveguide or optical guide. Each light guide 12 is associated with a light source in order to channel and orient the radiation therefrom in a main direction. The light source can be a light-emitting diode (LED). It can alternatively be a laser. A combination of light sources can be considered.

The material forming the light guide 12 is transparent. Here, it is a material for an optical lens, such as an organic material or possibly glass. It is made of a single piece. The light guide 12 makes it possible to distribute the area of emergence of the light rays over its length. This area can form a strip. To this end, the light guide 12 can comprise a body with a series of streaks distributed over a rear surface. The light guide 12 can be essentially elongate, that is to say that its length is greater than twice, preferably greater than four times, its width.

A control module makes it possible to manage the power supply for the light source. Its operation generates an electromagnetic field that the present casing 6 precisely makes it possible to intercept so as not to interfere with the rest of the vehicle.

Figure 2:
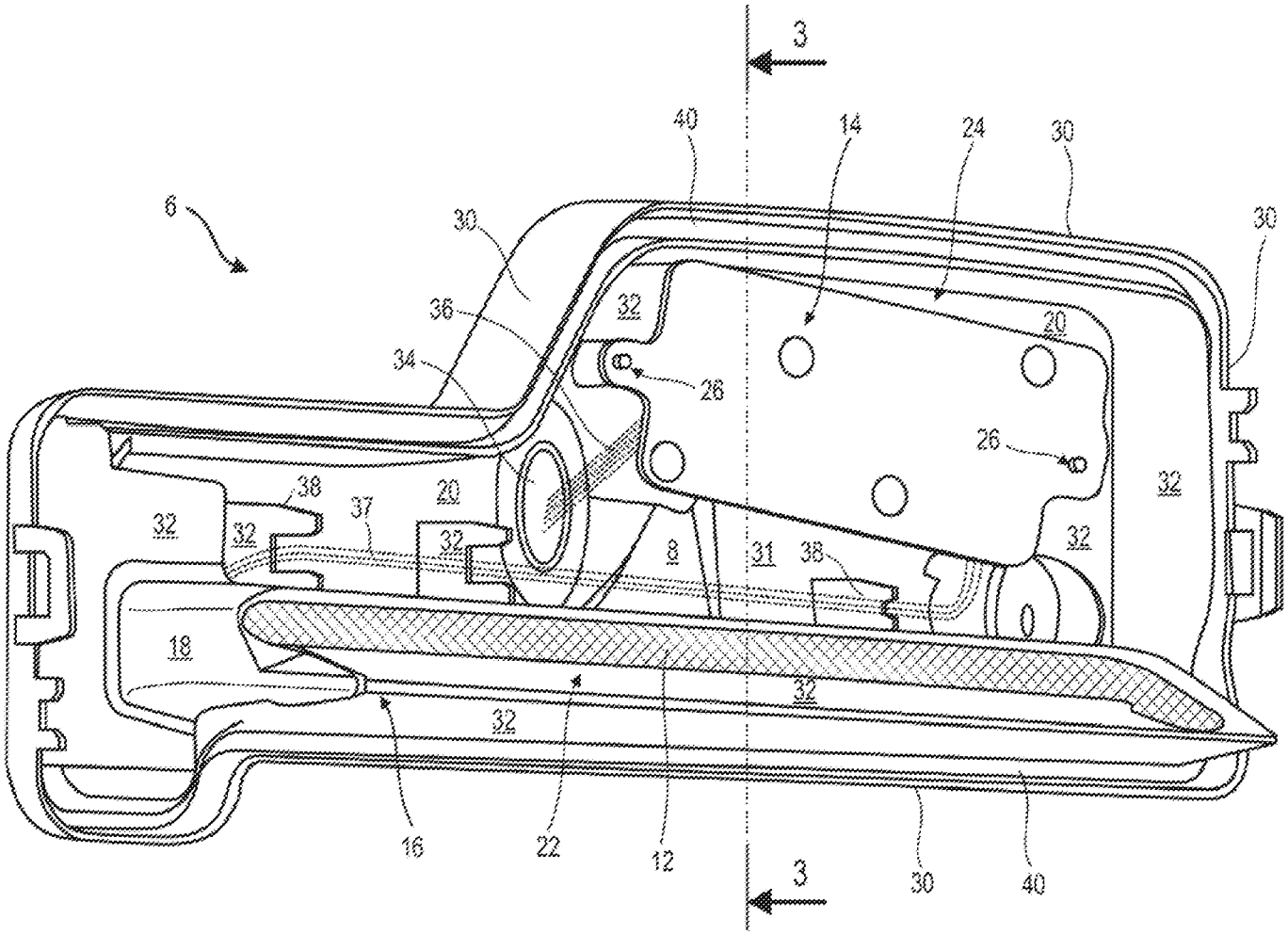
FIG. 2 illustrates an open light device according to the invention.

FIG. 2 shows a simplified representation of a subassembly of the light device. This subassembly comprises the casing 6, the control module 14; and possibly a light module 16 with the light guide 12 and a light source, which can be concealed by a cover 18. The cover 18 can also hide the printed circuits attached to the light source. The outer lens is absent, the housing 8 of the casing 6 is therefore open. A heat sink (not represented) can be coupled to the light source to cool it, this heat sink being advantageously outside of the casing 6.

The inner surface 20 of the casing 6 has several zones. A first zone 22 runs along the light guide 12, and is reflective in order to return a part of the light from the light guide 12 being propagated backward; in other words opposite the main direction of the light device 2. This first reflecting zone 22 passes through substantially all the length of the casing 6. The inner surface 20 also has a second zone 24 receiving the control module 14. This zone can form a fixing zone 24 for the control module 14 by virtue of the bosses 26 or blocks arranged at the ends of its length. The zone 24 for the control module 14 can form a widening, and/or an extensive zone. In the normal direction of mounting of the casing 6 on the vehicle, the width is measured vertically, and the depth is measured to the rear.

The control module 14 can generally form a plate. It can include a heat sink 28, for example in the form of a sheet metal. It can also have a printed circuit board with electrical components making it possible to adapt the electrical current of the vehicle to the functions that the light source has to provide. The electrical components are advantageously arranged toward the bottom of the casing 6. The board covers a smaller area than the sink 28.

The device 2 can be of the type with a longitudinal light guide 12. The latter can generally pass horizontally through the casing 6, and/or cover half the length of the casing 6. Length is understood to be in accordance with the main elongation of the casing 6.

The casing 6 can be produced in an electrically insulating material. It can be made of ceramic, or of polymer. It can comprise polypropylene, or polyamide. Other materials can be considered. The abovementioned materials provide a trade-off between the cost, the weight and the mechanical strength of the casing 6. The insulating material can be employed to form the walls (30; 31) of the casing, and notably the inner surface 20 defining the housing 8.

In order to avoid the electromagnetic field produced by the control module 14 being propagated to the interior of the vehicle, the casing 6 comprises an electrically conductive coating 32 which is also reflective. The latter is applied to the inner surface 20 of the casing 6, i.e. on and in contact with the insulating material. The coating 32 covers the reflecting zone 22 to return the radiations, and covers the fixing zone 24 to create an electromagnetic protection. The coating 32 can be uniform, of the same composition over its entire surface. It is linked to the ground of the vehicle in which the light device 2 is mounted, so that the electromagnetic waves are intercepted and are not propagated through the vehicle. In this way, the equipment items in the vehicle are not subjected to the electromagnetic interferences produced by the control module 14.

The coating 32 lines the inner surface 20 at the control module 14, in the zone 24 where the latter is fixed. Here, the coating 32 can also be reflective. The coating 32 can reach the opposite edges of the casing, for example the longitudinally opposite edges. It can coat most of the inner surface 20 of the casing 6, possibly substantially all. It covers both the bottom wall 31 of the casing 6, and each perimeter wall 30 which surrounds the bottom wall 31.

The coating 32 can comprise a conductive material which is applied in the form of a film to the interior of the casing. It is a surface deposition. The application can be performed in vapor phase of CVD (chemical vapor deposition) type, or by spraying. Other methods can be considered. The coating 32 can comprise a metal; for example aluminum, tin, or steel to guarantee optimal reflection. The electrical resistivity of the coating is less than or equal to 1000 10^(−9) Ω*m, preferentially less than or equal to 100 10^(−9) Ω*m, more preferentially less than or equal to 28 10^(−9) Ω*m; possibly greater than or equal to 25 10^(−9) Ω*m.

The casing 6 can have an opening 34 for the passage of power supply cables 36 connected to the electrical circuit of the vehicle. The opening 34 can generally be arranged in a central position to facilitate access thereto from the interior of the vehicle. The opening 34 can be circled by the coating 32. The light module 16 is powered from the control module 14 via auxiliary cables 37. They are held by virtue of fork-shaped guides 38. The guides 38 are also covered by the coating 32. The perimeter channel 40 of the casing 6, notably its bottom, and/or the cover 18, can be covered by the coating 32.

Figure 3:
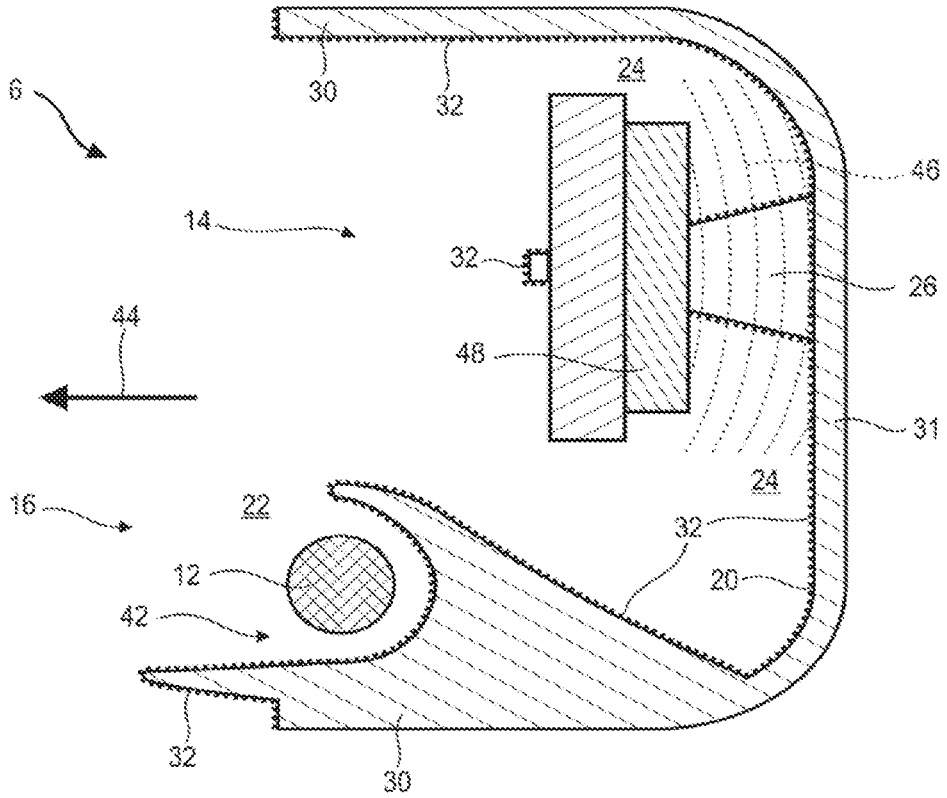
FIG. 3 shows a cross section of the casing according to the invention following the axis 3-3 drawn in FIG. 2.

FIG. 3 is a view in cross section of the casing 6 on the axis 3-3 drawn in FIG. 2. The light guide 12 and one of the bosses 26 supporting the control module 14 are represented.

The light guide 12 is arranged in the reflecting zone 22. It is placed in front of the longitudinal groove 42. The latter can show a profiled form, possibly with a profile in the form of a parabola. The light guide 12 can be arranged at the focal point of the parabola. The light guide 12 can be arranged at the focal point of the parabola in order to favor a return of the radiation from the light guide 12 in a predetermined direction, for example in the main direction 44 of light emission of the device 2.

The control module 14 is placed toward the rear of the light guide 12. One of its main faces is facing the rear part of the reflecting zone 22, that is to say the bottom wall 31. The corresponding surface can be followed in order to better block the electromagnetic waves 46 emitted by the control printed circuit board 48. The control module 14 is rigidly linked to the casing 6, the link being made by virtue of the bosses 26. These are also covered by the coating 32 so that the casing 6 is tight to the electromagnetic waves 46; so that no breach remains.

A part of wall (30; 31) can cover the light guide 12 so as to form an occulting screen with respect to another part of wall. This screen conceals an area of the fixing zone 24. It can also be concealed by the control module 14 itself. The occulted area does not receive direct radiation from the light module 16. The occulted area is also covered by the coating 32, partially or totally.

Figure 4:
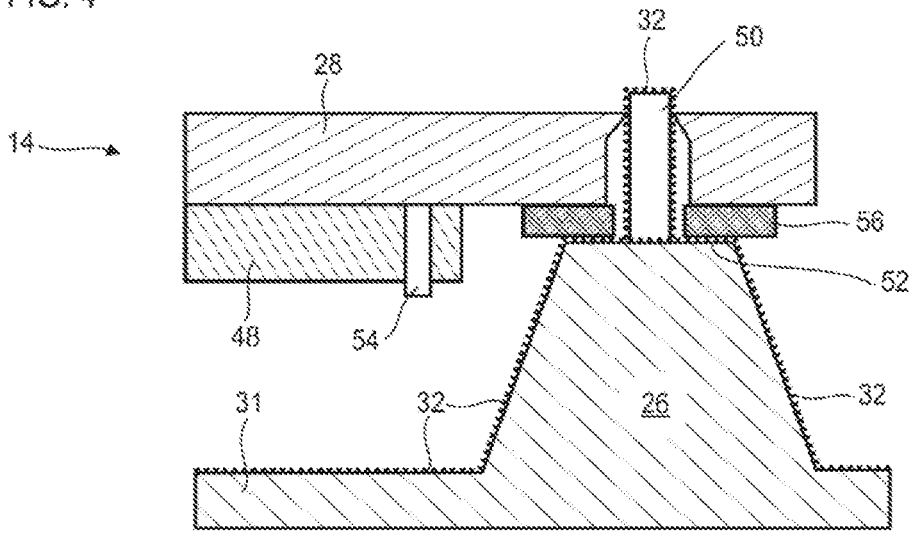
FIG. 4 sketches the contact between a control module and a boss according to the invention.

FIG. 4 represents a link between a boss 26 and the control module 14. An electrically insulating portion of wall, in this case the bottom wall 31, is also represented. Although just one link is represented, the present teaching can be applied to each link of this type.

At least one or each boss 26 can comprise a fixing axis 50 and a shoulder 52 against which the control module 14 rests. The latter can also comprise fixing orifices in which the fixing axes 50 are linked. The shoulders 52 can be coplanar to allow a surface-to-surface bearing of a face of the control module 15, in this case a face of the heat sink 28.

The boss 26 is covered by the coating 32, in particular its shoulder 52 and/or its fixing axis 50. This allows an electrical contact between the control module 14 and the coating 32 which is itself linked to the ground of the vehicle. The printed circuit board 48 is also connected electrically to the heat sink 28 by virtue of an electrical terminal 54 which crosses the printed circuit board 48. In this way, the latter is also linked to the ground of the vehicle, which simplifies the electrical connections, and which can possibly save on a cable.

In order to improve the electrical contact, a conductive washer 56, for example made of aluminum, is threaded around the fixing axis 50. The washer 56 is in contact with the coating 32 and the heat sink 28. The presence of the washer is not essential since the heat sink can be directly in contact with the boss, whether it is the axis or the shoulder.

The invention claimed is:

1. A casing for a light-device, the casing made of an electrically insulating material and including an inner surface forming a housing, the housing being closed by an outer lens and including a light module therein, the inner surface comprising:

a reflecting portion and a fixing portion, the reflecting portion configured to reflect the light emitted by the light module out of the casing, the fixing portion facing and partially enclosing a control module of the light module, wherein the inner surface comprises a reflecting and electrically conductive coating covering in the entirety and in contact with both the reflecting portion and the fixing portion of the control module in order to block the electromagnetic field produced by the control module, the reflecting portion is in contact with the fixing portion and is an extension of the fixing portion, and the reflecting and electrically conductive coating covering the reflecting portion is electrically connected to the reflecting and electrically conductive layer covering the fixing portion, wherein in a cross section of the inner surface, a contact point between the fixing portion and the reflecting portion is an inflection point of the inner surface, wherein both the reflecting portion of the inner surface and the fixing portion of the inner surface are positioned in openings of two respective cavities facing in the same direction.

2. The casing according to claim 1, wherein the coating is metallic and extends over substantially all of the inner surface of the casing.

3. The casing according to claim 1, wherein the coating comprises aluminum and the electrically insulating material of the casing is a polymer.

4. The casing according to claim 1, wherein the fixing portion for the control module is bordered by at least two fixing bosses facing one another, the bosses being covered by the coating.

5. The casing according to claim 4, wherein at least one or each boss comprises a shoulder forming a bearing surface for the control module, and a fixing axis protruding from the associated shoulder, each shoulder and each fixing axis being covered by the coating.

6. The casing according to claim 1, wherein the light-device comprises a central opening, which is bordered, preferentially surrounded, by the coating.

7. The casing according to claim 1, wherein the reflecting portion forms a longitudinal groove suitable for reflecting light from a longitudinal light guide in a main direction, the coating covering the longitudinal groove.

8. The casing according to claim 1, wherein, in a normal mounting direction, the coating is more backward relative to a main direction of light emission of the light-device in the fixing portion than in the reflecting portion.

9. A light-device for a motor vehicle, the light-device comprising:

a casing and an outer lens which delimit a housing; and a light module which is arranged in the housing and which comprises a light source and a light guide associated with the light source, the casing being made of an electrically insulating material and including an inner surface forming the housing, the housing being closed by the outer lens and including the light module, the inner surface comprising a reflecting portion and a fixing portion, wherein the reflecting portion is configured to reflect the light emitted by the light module out of the casing, the fixing portion faces and partially encloses a control module of the light module, the inner surface comprises a reflecting and electrically conductive coating covering in the entirety and in contact with both the reflecting portion and the fixing portion of the control module in order to block the electromagnetic field produced by the control module, the reflecting portion is in contact with the fixing portion and is an extension of the fixing portion, and the reflecting and electrically conductive layer covering the reflecting portion is electrically connected to the reflecting and electrically conductive layer covering the fixing portion, wherein in a cross section of the inner surface, a contact point between the fixing portion and the reflecting portion is an inflection point of the inner surface, wherein both the reflecting portion of the inner surface and the fixing portion of the inner surface are positioned in openings of two respective cavities facing in the same direction.

10. The light-device according to claim 9, wherein the control module comprises a heat sink in contact with the coating.

11. The light-device according to claim 10, wherein the light-device comprises an electrically conductive washer at the interface between the coating and the heat sink in order to ensure an electrical connection.

12. The light-device according to claim 9, wherein the light-device comprises an occulting screen between the fixing portion and the light module which intercepts the radiation from the light module, the field occulted by the screen being also covered by the coating.

13. The light-device according to claim 9, wherein the control module comprises a printed circuit board connected to the light module and to the coating.

14. The light-device according to claim 9, wherein the control module comprises two thickness-wise opposing main faces, the coating closely following substantially all of a main face of the control module.

15. The light-device according to claim 9, wherein the light guide extends over substantially all of the length of the light-device, the coating running along substantially all of the length of the light guide.

* * * * *